US006710751B2

(12) United States Patent
Ianello et al.

(10) Patent No.: US 6,710,751 B2
(45) Date of Patent: Mar. 23, 2004

(54) ROTATABLE PLATFORM FOR LATTICE TOWERS

(75) Inventors: Daniel J. Ianello, Mishawaka, IN (US); Thomas N. Strantz, Osceola, IN (US)

(73) Assignee: PiRod, Inc., Plymouth, IN (US)

( * ) Notice: Subject to any disclaimer, the term of this patent is extended or adjusted under 35 U.S.C. 154(b) by 0 days.

(21) Appl. No.: 10/198,950

(22) Filed: Jul. 19, 2002

(65) Prior Publication Data

US 2004/0032375 A1 Feb. 19, 2004

(Under 37 CFR 1.47)

Related U.S. Application Data

(60) Provisional application No. 60/306,579, filed on Jul. 19, 2001.

(51) Int. Cl.[7] ..... H01Q 1/12

(52) U.S. Cl. ..... 343/890; 248/230.1; 52/40

(58) Field of Search ..... 343/890, 882, 343/891, 874; 248/219.4, 230.1; 52/40; H01Q 1/12

(56) References Cited

U.S. PATENT DOCUMENTS

| | | | | |
|---|---|---|---|---|
| 3,944,081 A | | 3/1976 | Wellman | |
| 4,652,177 A | | 3/1987 | Gunther, Jr. et al. | |
| 4,698,640 A | | 10/1987 | Redman | |
| 5,075,681 A | | 12/1991 | Kartiala | |
| 5,486,835 A | | 1/1996 | Hock | |
| 5,533,304 A | | 7/1996 | Noble | |
| 5,649,402 A | * | 7/1997 | Moore | 343/890 |
| 5,787,673 A | | 8/1998 | Noble | |
| 5,805,115 A | | 9/1998 | Pellerin et al. | |
| 5,954,305 A | | 9/1999 | Calabro | |
| 6,018,325 A | | 1/2000 | Lundgren | |
| 6,028,566 A | | 2/2000 | Pennell et al. | |
| 6,123,067 A | | 9/2000 | Warrick | |
| 6,198,452 B1 | | 3/2001 | Beheler et al. | |
| 6,249,261 B1 | * | 6/2001 | Solberg, Jr. et al. | 343/801 |

FOREIGN PATENT DOCUMENTS

| | | |
|---|---|---|
| JP | 11234011 | 8/1999 |
| WO | WO 96/11352 | 4/1996 |

OTHER PUBLICATIONS

Copy of International Search Report issued in a corresponding international patent application dated Oct. 28, 2002.

Photograph of Monopole Tower and Antenna Platform found on website, http://www.trinityinc.com/images/cell-towers/150ftcelltower.gif, printed on Dec. 2, 2002, 1 page.

* cited by examiner

*Primary Examiner*—Hoanganh Le
(74) *Attorney, Agent, or Firm*—Baker & Daniels

(57) ABSTRACT

A tower, an antenna platform and a mounting assembly for rotatably mounting the antenna platform to the tower. The mounting assembly includes tower mounting members for attaching the mounting assembly to the tower, platform mounting members for attaching the antenna platform to the mounting assembly, and rotational members to facilitate rotation of the antenna platform about a longitudinal axis of the tower. The mounting assembly enables the antenna platform to be set at any desired position about a 360-degree azimuth. The rotational members include a ring and the ring includes ring segments. If three ring segments are used, the mounting assembly enables rotation of the antenna platform along a 120-degree arc while the platform is connected to the tower. The platform mounting members are attached to the ring between the segments thereof. Centering clamps are provided to maintain centering of the platform about the longitudinal axis of the tower while the rotational members are being rotated.

36 Claims, 13 Drawing Sheets

22
20
26
38
36
30
A
10
12

ROTATABLE PLATFORM FOR LATTICE TOWERS

BACKGROUND OF INVENTION

This application claims the benefit of the U.S. Provisional Patent Application, Serial No. 60/306,579 filed Jul. 19, 2001, the complete disclosure of which is hereby expressly incorporated herein by reference.

Antenna poles or towers have long been in use for transmission, reception and forwarding of radio and television signals. In addition, microwave antennae have come into frequent demand and usage for cellular communications. Such poles or towers generally range in height from 80 to 220 feet or more. It is also common to place an antenna support or platform upon the poles or towers for mounting antennae thereto for reception and transmission of signals. It is common for the antenna platforms to have a generally triangular shape, such as is shown in U.S. Pat. No. 5,787,673 to M. Noble, herein incorporated by reference.

It has been found that lattice-type towers provide an economical, efficient and stable support for mounting an antenna platform. Lattice towers often consist of a generally triangular-shaped framework utilizing a truss-type construction.

One drawback of lattice towers for supporting an antenna platform is the fact that it has been heretofore unknown to have a means or method to readily rotate an antenna platform about a lattice tower. This is because the triangular shape of lattice towers does not readily accommodate a rotational mechanism. It is desirable to have this ability to rotate the platform so that the receiving and transmitting of signals may be optimized.

It is therefore an object of the invention to provide a rotatable antenna platform and mount that is suitable for use on a lattice tower. It is a further object of the invention to provide such rotatable means in an efficient and economical manner.

SUMMARY OF THE INVENTION

It is a feature of the invention to provide a tower, an antenna platform and a mounting assembly for rotatably mounting the antenna platform to the tower. The antenna platform of the embodiment shown includes a frame and antenna mounting members. The tower is a lattice-type tower and includes three vertical support legs joined to one another by trusses.

In one embodiment, the mounting assembly includes tower mounting members for attaching the mounting assembly to the tower, platform mounting members for attaching the antenna platform to the mounting assembly, and rotational members to facilitate rotation of the antenna platform about a longitudinal axis of the tower. The mounting assembly enables the antenna platform to be set at any desired position about a 360-degree azimuth.

In an embodiment shown, the rotational members include a ring. The ring may include ring segments. This embodiment has three ring segments and the mounting assembly allows rotation of the antenna platform along a 120-degree arc while the platform is connected to the tower. The platform mounting members are attached to the ring between the segments thereof.

It is also an embodiment of the invention, that the platform mounting members have a plate and a gusset, and the ring segments have flanges attached to the ends thereof.

The flanges of the ring segments are attached to a gusset on one of the platform support brackets.

The ring may be mounted to be slidable relative to the tower mounting members. Furthermore, the ring may be secured to preclude slidable movement relative to the tower mounting members. In one embodiment, the ring is mounted to the tower mounting members with U-bolts.

It is also an aspect of the invention to provide centering clamps to maintain centering of the platform with respect to the longitudinal axis of the tower while the rotational members are being rotated. In the embodiment shown, the centering clamps are attached to the tower mounting members and have a T-shape including a center flange. The flange is perpendicular to a retaining plate. The centering clamps are positioned to be juxtaposed the inner diameter of the ring.

DETAILED DESCRIPTION OF THE INVENTION

Figure 1:
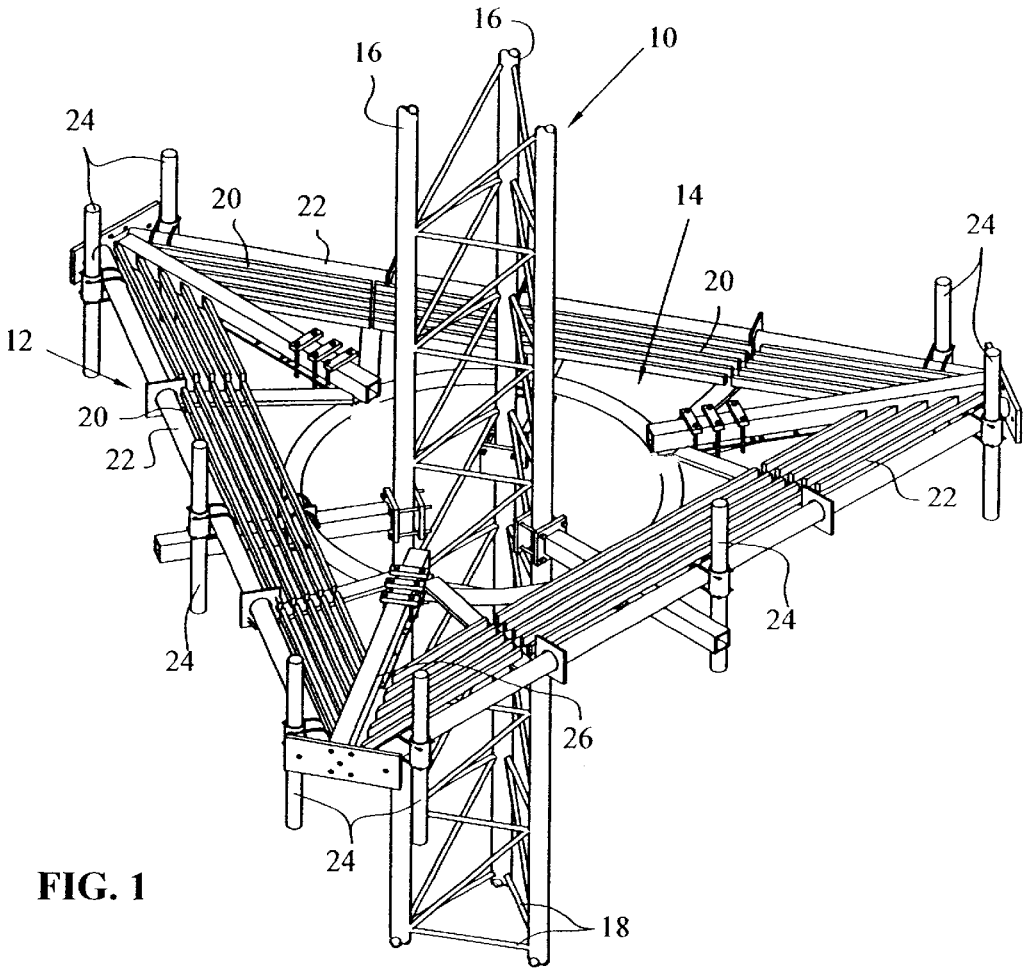
FIG. 1 is a perspective view of a lattice tower having a rotatable antenna platform according to the subject invention mounted thereon.
Figures 4, 6, 8:
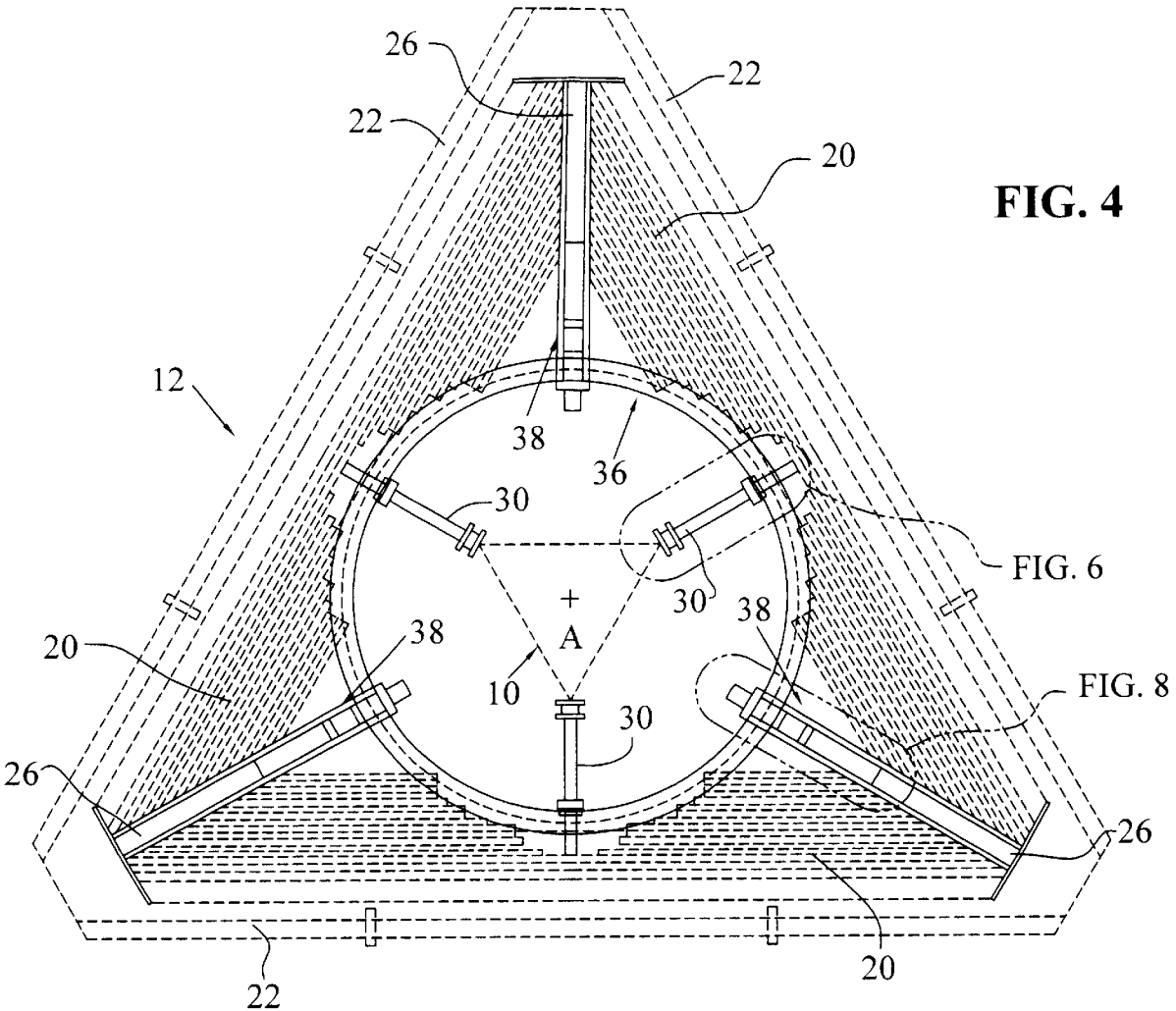
FIG. 4 is a plan view of the rotatable antenna platform and mounting assembly with the tower and platform shown in phantom lines.
FIG. 6 is a close up top view taken from FIG. 4 of a portion of a ring segment of the rotatable mounting assembly mounted to a tower mounting member.
FIG. 8 is a close up top view taken from FIG. 4 of the mounting of a pair of ring segments to the antenna platform with the antenna platform shown in phantom lines.
Figure 5:
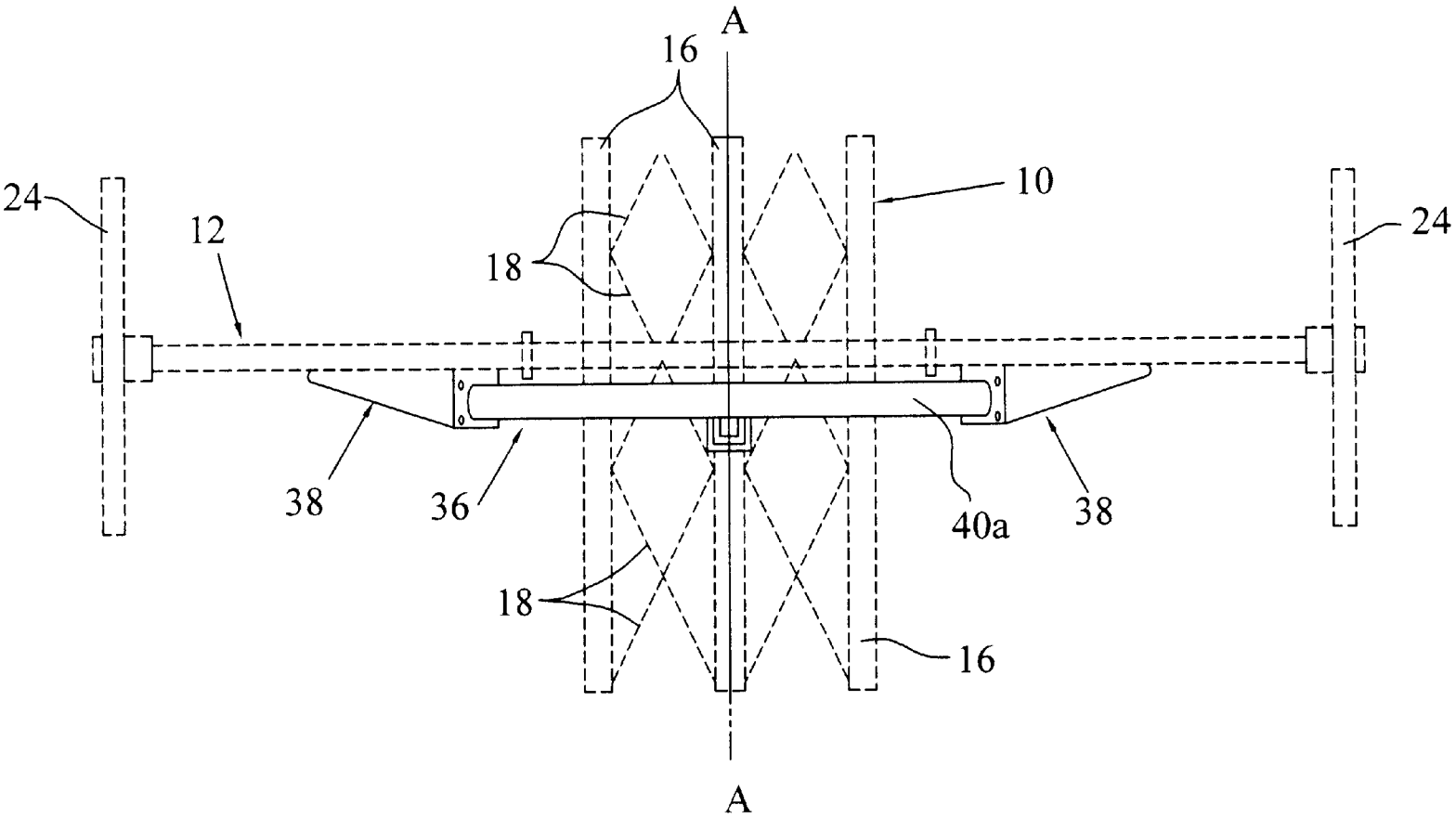
FIG. 5 is a side view of the lattice tower, rotatable antenna platform, and mounting assembly with the tower and platform shown in phantom lines.
Figure 6:
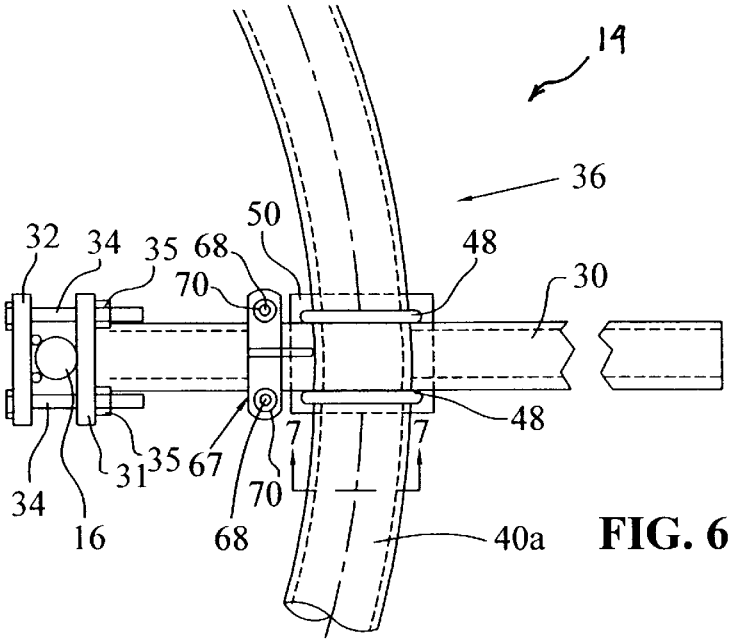

Referring to the FIG. 1, a lattice tower is shown generally indicated as 10. The lattice tower has an antenna platform generally indicated as 12 that is rotatably mounted thereupon with a mounting assembly generally indicated as 14. The lattice tower 10 has a generally triangular configuration and includes three generally vertically oriented structural support legs 16 which are secured to one another with truss members/braces 18. Lattice tower 10 is oriented along a longitudinal axis A as shown in FIGS. 4 and 5.

Antenna platform 12 also has a generally triangular shape and includes horizontal members 20, an outer frame 22 and vertically oriented antenna mounting pipes 24. Between the horizontal members 20 are radially aligned horizontal supports 26. The lattice tower and antenna platform described above are both well known in the art.

Figure 2:
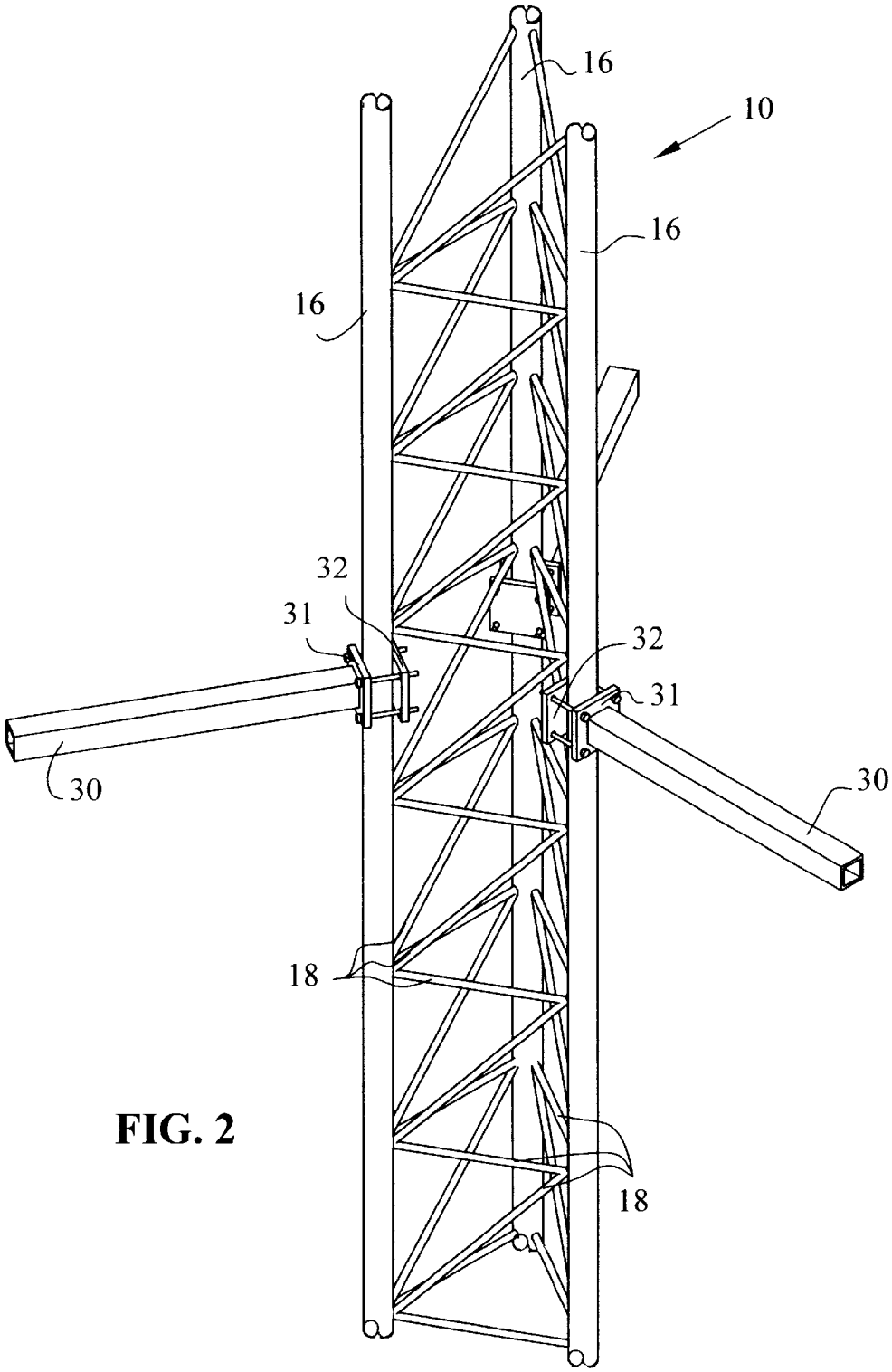
FIG. 2 is a perspective view of the lattice tower with tower mounting members attached thereto.

The mounting assembly 14 generally includes tower mounting members 30 (FIG. 2), a circular ring generally indicated as 36 (FIG. 3) and platform mounting members/support brackets generally indicated as 38, as are best shown in FIGS. 6–9. In the embodiment shown, the tower mounting members 30 are formed from box-shaped structural members and have an end flange 31 attached thereto. The tower mounting members are attached to the lattice tower 10 using mounting brackets 32, bolts 34, and nuts 35 or other attachment means well known in the art. The bolts 34 are positioned in mating apertures (not shown) in end flanges 31 and brackets 32.

Figure 3:
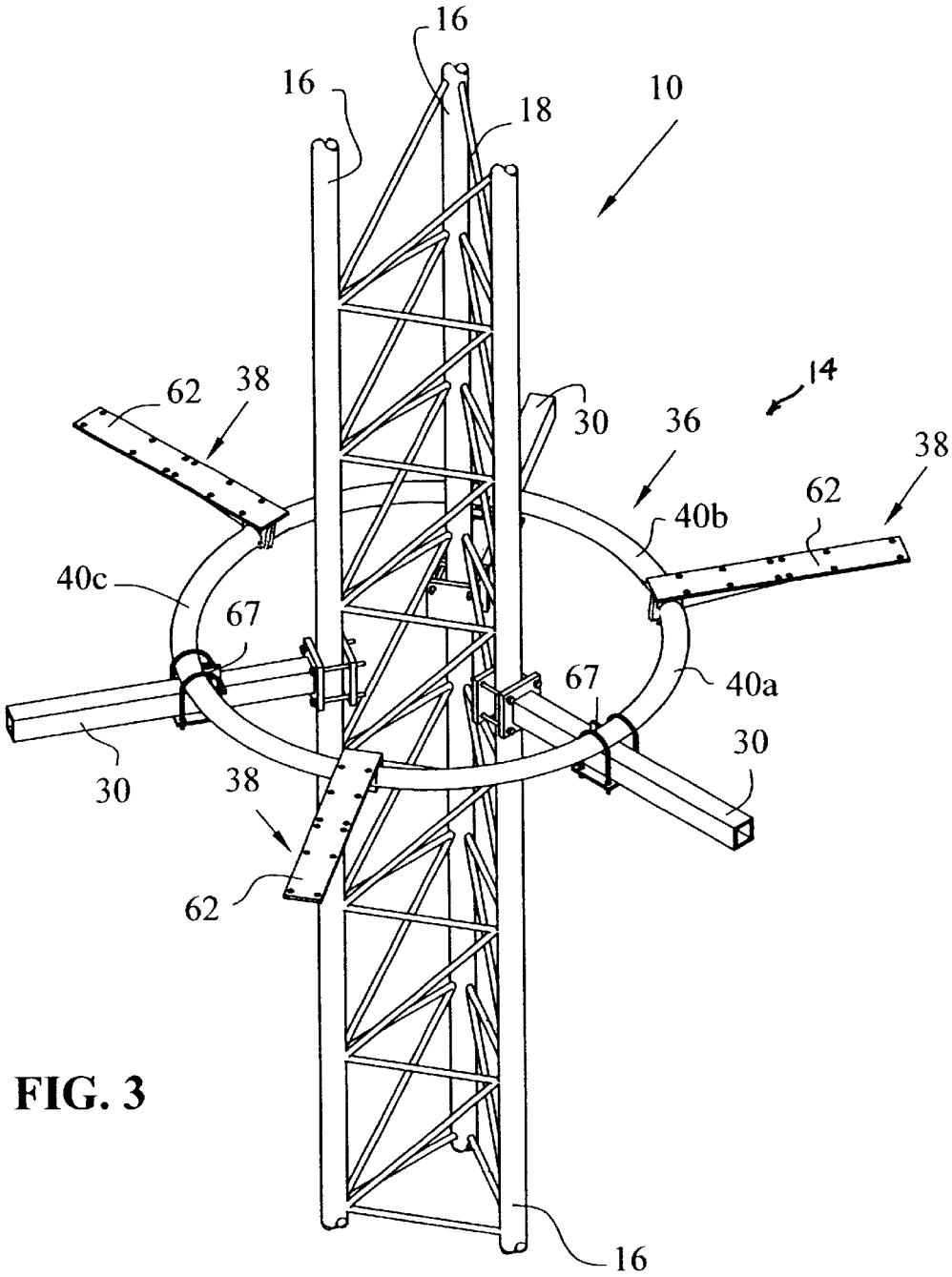
FIG. 3 is a perspective view of the lattice tower showing rotational members mounted to the tower mounting members.
Figure 7:
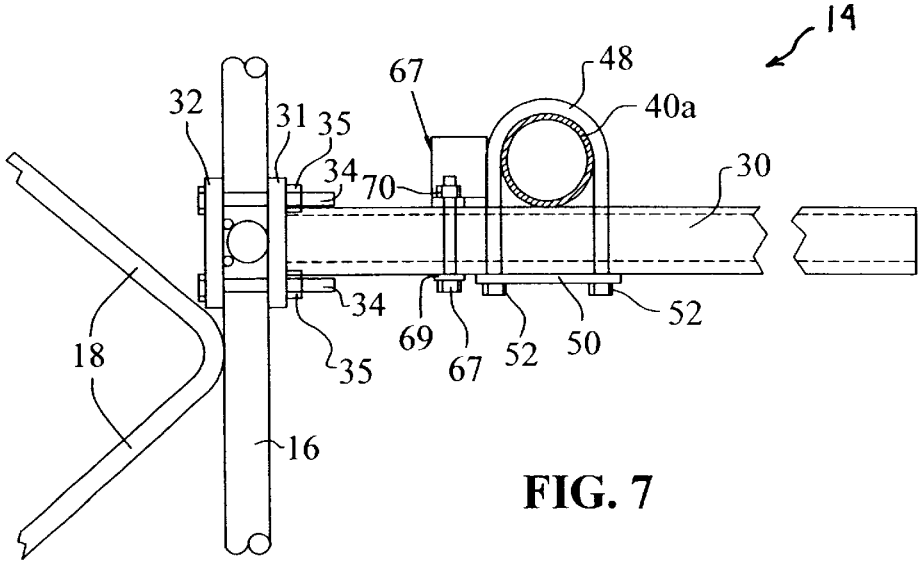
FIG. 7 is a cross sectional view taken as shown in FIG. 6 of the ring segment mounted to the tower mounting member.
Figure 8:
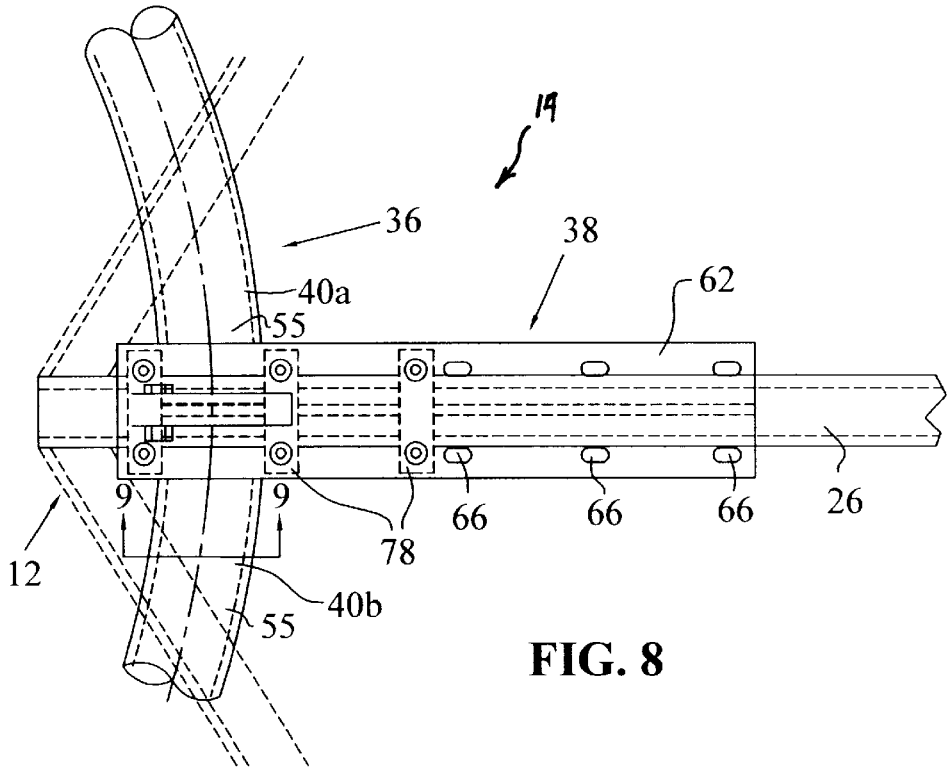

As shown in FIG. 3, ring 36 includes three ring segments 40*a*, 40*b*, 40*c*, which are supported upon the tower mounting members 30. The ring segments are held firmly to the tower mounting members 30 with mounting hardware including U-bolts 48, mounting plates 50, and nuts 52, as best shown in FIG. 7. The U-bolts straddle the mounting members 30 and extend through the mounting plates 50 to be secured thereto with the nuts 52 as detailed below.

Figure 10:
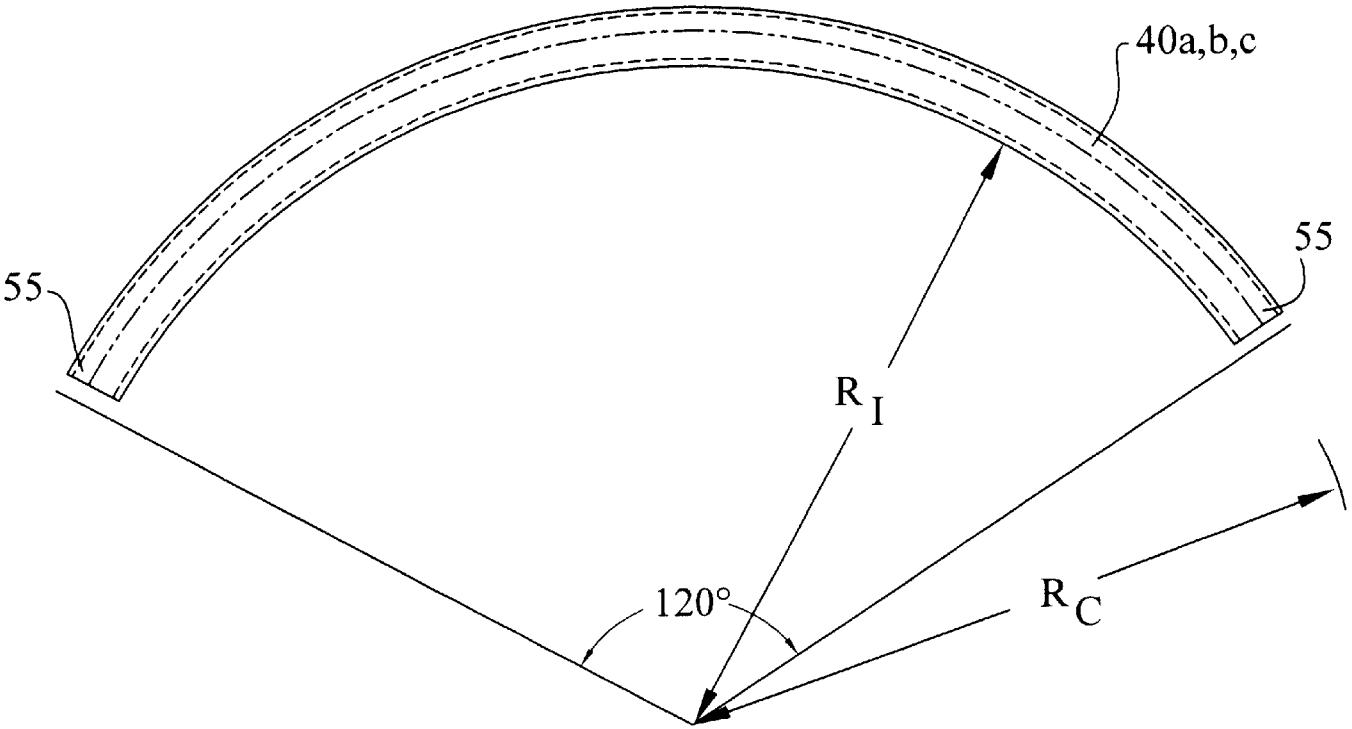
FIG. 10 is a plan view of a single ring segment.
Figure 11:
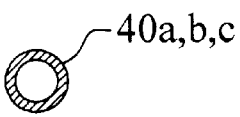
FIG. 11 is cross sectional view of the ring segment of FIG. 10.
Figure 12:
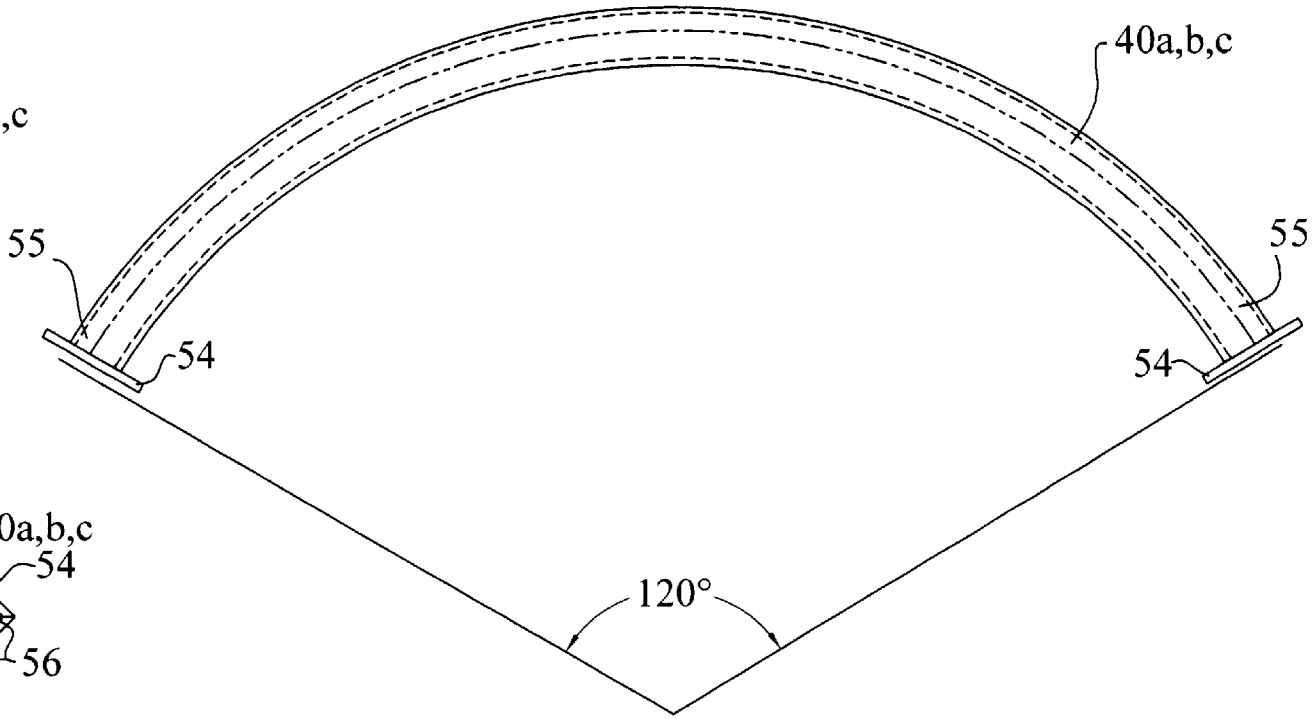
FIG. 12 is a plan view of the ring segment of FIG. 10 having end flanges attached thereto.
Figure 13:
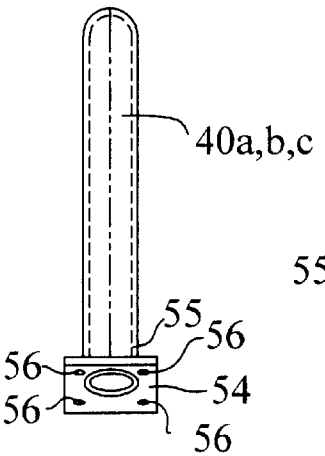
FIG. 13 is a side view of the ring segment of FIG. 12 with the end flanges attached.
Figure 14:
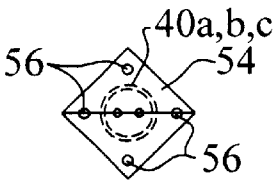
FIG. 14 is an end view of the ring segment of FIG. 12 with the end flanges attached.

The ring segments 40*a*, 40*b*, 40*c* each extend approximately 120 degrees about the ring 36. An embodiment of the ring segments 40*a*, 40*b*, 40*c* is shown in FIGS. 10 and 11. In this embodiment, ring segments 40*a*, 40*b*, 40*c* are shaped in an arc of approximately 120 degrees. The arc of ring segments 40*a*, 40*b*, 40*c* is formed about a radius wherein the inner side of the segment is formed along a radius $R_I$ Radius $R_C$ coincides with the center of the ring segment. As shown in FIG. 11, ring segments 40*a*, 40*b*, 40*c* are made from a hollow circular structural member. Flanges 54 are attached to each end 55 of ring segments 40*a*, 40*b*, 40*c* and the flanges have apertures 56 extending therethrough as shown in FIGS. 12–14.

One platform mounting member 38 is located between each ring segment and extends outwardly therefrom. The end flanges 54 of the ring segments 40*a*, 40*b*, 40*c* are attached to the respective platform mounting member 38 located therebetween using bolts 57 and nuts (not shown) as will be discussed in more detail below.

Figure 17:
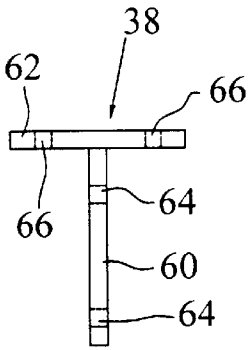
FIG. 17 is an end view of the platform support bracket of FIG. 15 for the rotatable platform mount.
Figure 15:
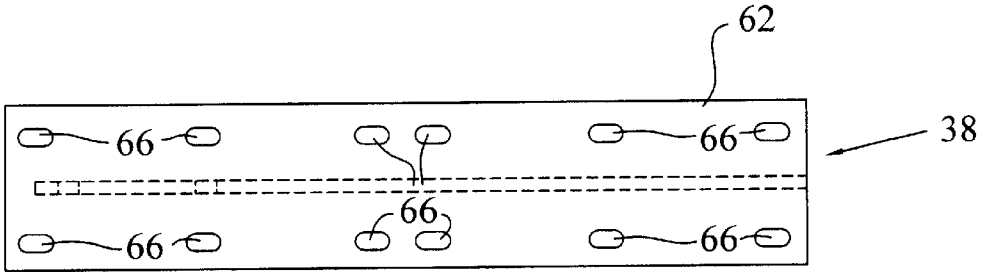
FIG. 15 is a plan view of a platform support bracket for the rotatable platform mount.
Figure 16:
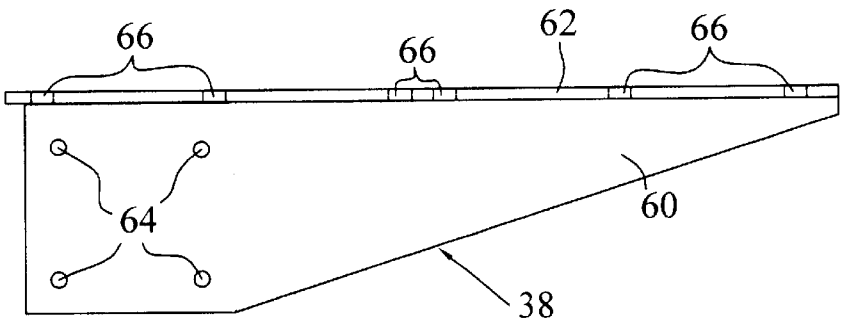
FIG. 16 is a side view of the platform support bracket of FIG. 15 for the rotatable platform mount.

The platform mounting members 38 are detailed in FIGS. 15–17. Each platform mounting member has a gusset 60 and a mounting plate 62. Gusset 60 is mounted perpendicular to mounting plate 62 in approximately the central portion thereof using an arc welding process or other attachment means well known in the art. Gusset 60 includes through apertures 64 and mounting plate 62 includes elongated through apertures 66.

Now referring to FIGS. 6 and 7, it can be seen that mounting assembly 14 also includes centering clamps generally indicated as 67, which are affixed to tower mounting members 30 using bolts 68, mounting plates 69 and nuts 70. A pair of the bolts 68 straddle each tower mounting member 30.

Figure 18:
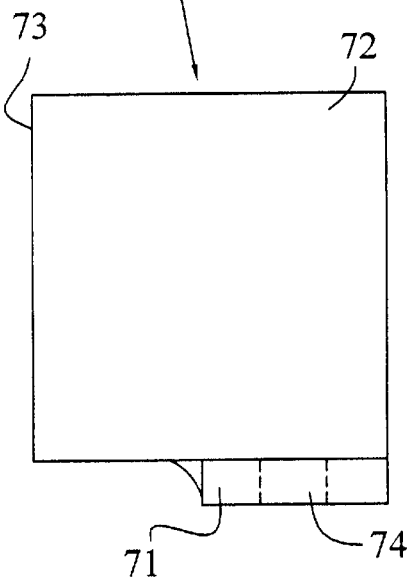
FIG. 18 is a side view of a centering clamp for the rotatable platform mount.
Figure 19:
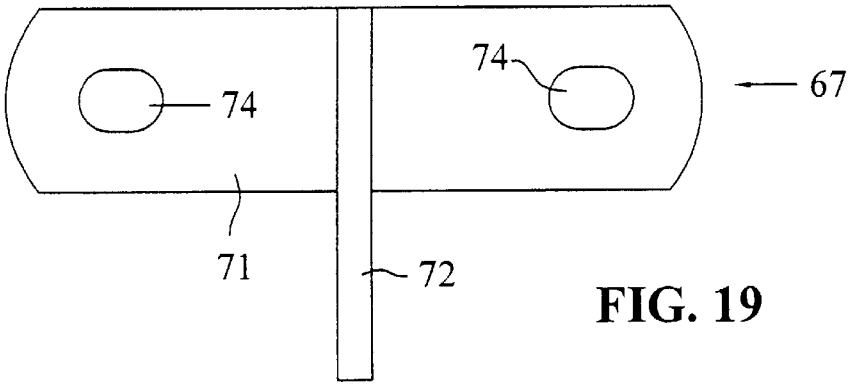
FIG. 19 is a top view of the centering clamp of FIG. 18 for the rotatable platform mount.
Figure 20:
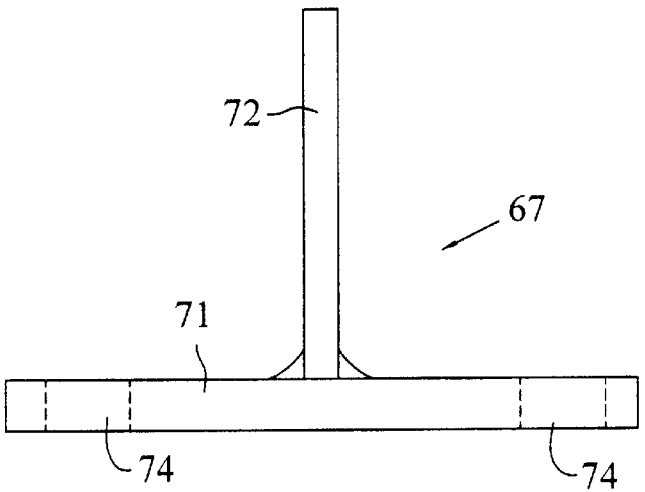
FIG. 20 is an end view of the centering clamp of FIG. 18 for the rotatable platform mount.

The centering clamps 67 are depicted in detail in FIG. 18–20. Each centering clamp 42 includes a flange 71 and a retaining plate 72 having an outer edge 73. The retaining plate is mounted to the central portion of the flange utilizing an arc welding process or other well-known joining technique. In the embodiment shown, flange 71 is rounded on the ends, and includes slotted holes 74. Furthermore, flange 71 does not extend across the complete width of the retaining plate 72. As is shown in FIGS. 18 and 19, flange 71 is approximately one-half the width of retaining plate 72.

Figure 9:
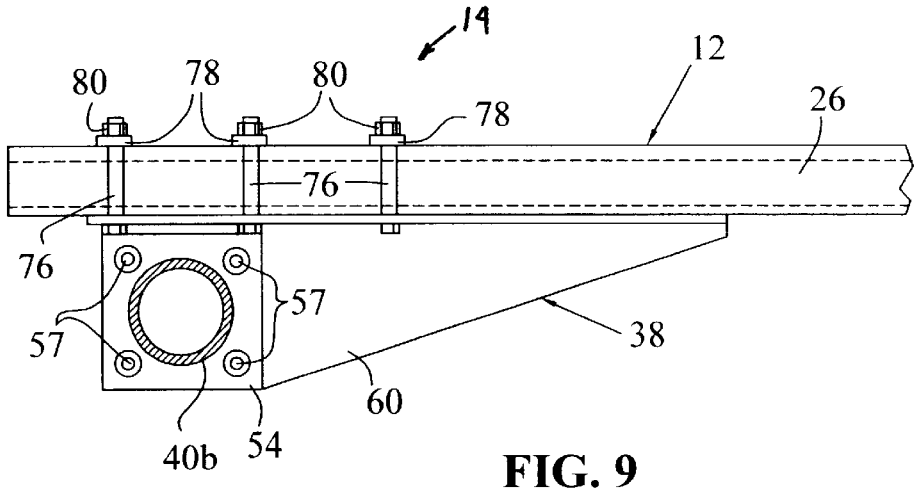
FIG. 9 is a side cross sectional view taken as shown in FIG. 8 of the mounting of the pair of ring segments to the antenna platform with the antenna platform shown in phantom lines.

Additional mounting hardware included in mounting assembly 14 include bolts 76, securing plates 78, and nuts 80 (FIG. 9).

Having discussed the major component parts of the subject invention, the assembly and operation will now be discussed in further detail. As discussed above, the embodiment depicted in the figures utilizes a lattice-type tower. Preferably, the tower 10 is pre-fabricated before taking it to the installation site or sections of the tower 10 are pre-fabricated and erected and attached to one another at the installation site. Antenna platform 12 is likewise pre-fabricated or partially pre-fabricated before installation. To install the antenna platform 12, the tower mounting members 30 are first attached to the vertical support legs 16 using mounting brackets 32, bolts 34, and nuts 35. As discussed above, the bolts are placed through apertures in flange 31 of tower mounting members 30 and through mating apertures in bracket 32 and secured with nuts 35. As will be apparent to one skilled in the art, tower mounting members 30 are installed at a height on the tower where it is desired to mount the antenna platform 12. In the embodiment shown, there is one tower mounting member 30 for each vertical support leg 16 making a total of three tower mounting members. The tower mounting members 30 are mounted in a generally horizontal direction extending radially outward from the longitudinal axis A of tower 10.

Next, one centering clamp 67 is attached to each tower mounting member 30 using a pair of the bolts 68, one mounting plate 69 and a pair of the nuts 70. The centering clamps are placed on the top of the tower mounting members 30 with plates 69 to the underside thereof. One bolt 68 is placed on each side of the tower mounting members through apertures (not shown) located in plate 69 and through apertures 74 in flange 71 of the centering clamp 67. The bolts 68 are secured with the nuts 70. The centering clamps 67 are located equal-distant from the vertical support legs 16 so that the outer edges 73 of retaining plates 72 extend out from longitudinal axis A at a distance equal to or slightly smaller than the inner diameter of ring 36 which coincides with radius $R_i$ for reasons as will be explained more fully below.

Ring 36 is also pre-assembled prior to mounting to tower 10. The ring is assembled such that the flanges 54 on the ends 55 of adjoining ring segments 40*a* and 40*b* are attached to one of the gussets 60 on one of the platform mounting members 38 as shown in FIGS. 8 and 9. The flanges 54 are attached to the gusset by aligning apertures 56 in flanges 54 with apertures 64 in gusset 60 and connecting the flanges and gusset together using bolts 57 and nuts (not shown) or other attachment means well known in the art. When all of the flanges 54 are attached to the respective gussets 60 of platform mounting members 38, the ring 36 appears as shown in FIG. 3 with the mounting plates 62 of platform mounting members 38 extending in a generally horizontal plane radially outward from ring 36.

Ring 36 is then placed about tower 10 as shown in FIG. 3. The platform mounting members 38 are aligned in an approximate position wherein it is anticipated the corners of generally triangular-shaped platform 12 should be placed to provide optimal transmission and receipt of signals. When fitting the ring 36 about the tower 10, the ring is placed about centering clamps 67 so that the outer edges 73 of retaining plates 72 are adjacent to the inner side/diameter of ring 36. In this manner, ring 36 may be rotated about the longitudinal axis A of tower 10 by sliding it upon tower mounting members 30 until the desired position is attained. The centering clamps 67 prevent lateral movement of ring 36 other than rotation thereof; therefore, the center of ring 36 will be maintained in alignment with longitudinal axis A of tower 10 as the ring is rotated.

When the ring is in the desired position, U-bolts 48, which are sized to have a radius slightly larger than the outside radius of the circular cross-section of ring segments 40*a*, 40*b*, 40*c*, are placed over the ring as shown in FIGS. 3, 6 and 7. The U-bolts 48 are placed such that one is on each side of each tower mounting member 30. The lower threaded ends of the U-bolts are placed through apertures in mounting plates 50 and secured with nuts 52.

Next, the antenna platform 12 may be placed about tower 10 and attached to the platform mounting members 38. In the embodiment shown, mounting plates 62 each contain six pairs of the elongated apertures 66. The platform 12 is attached to the platform mounting members 38 through three pairs of elongated apertures 66. As can be seen in FIGS. 8 and 9, the horizontal supports 26 of antenna platform 12 are attached to mounting plate 62 using three pairs of bolts 76, securing plates 78, and nuts 80. The bolts are positioned through the three innermost pairs of elongated apertures 66 with each pair of bolts also extending through one of the securing plates 78 and secured with nuts 80. As is shown, each pair of bolts straddle horizontal support 26. If a larger diameter antenna platform 12 were mounted to ring 36, then the outermost three pairs of elongated apertures 66 would be used to mount the platform. Of course, other hole and bolt patterns may be used based upon the size of the platform to be mounted.

Figure 3A:
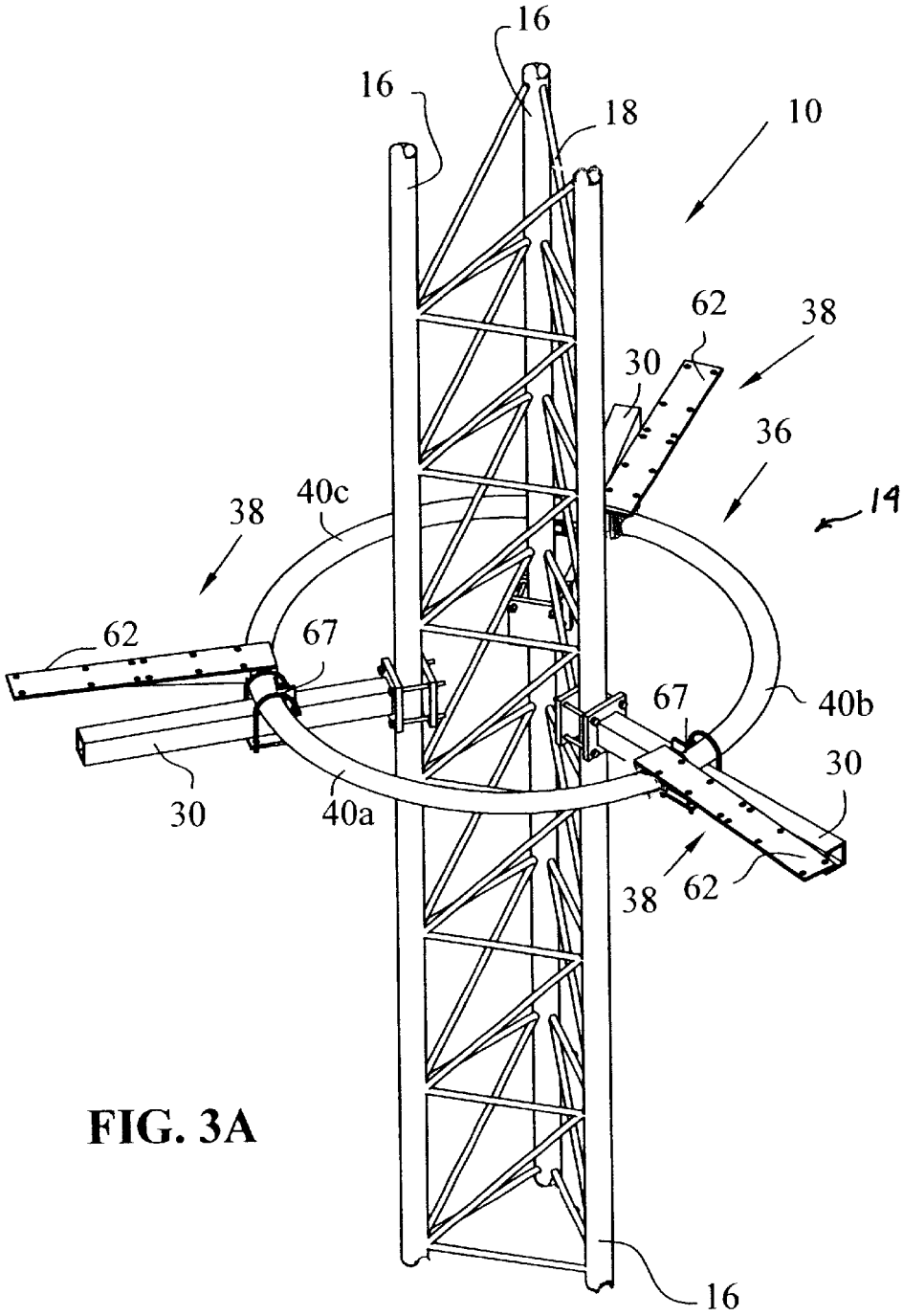
FIG. 3A is a perspective view of the lattice tower showing the rotational members rotated to 120° stopping point when the rotational members are mounted to the tower mounting members.
Figure 3B:
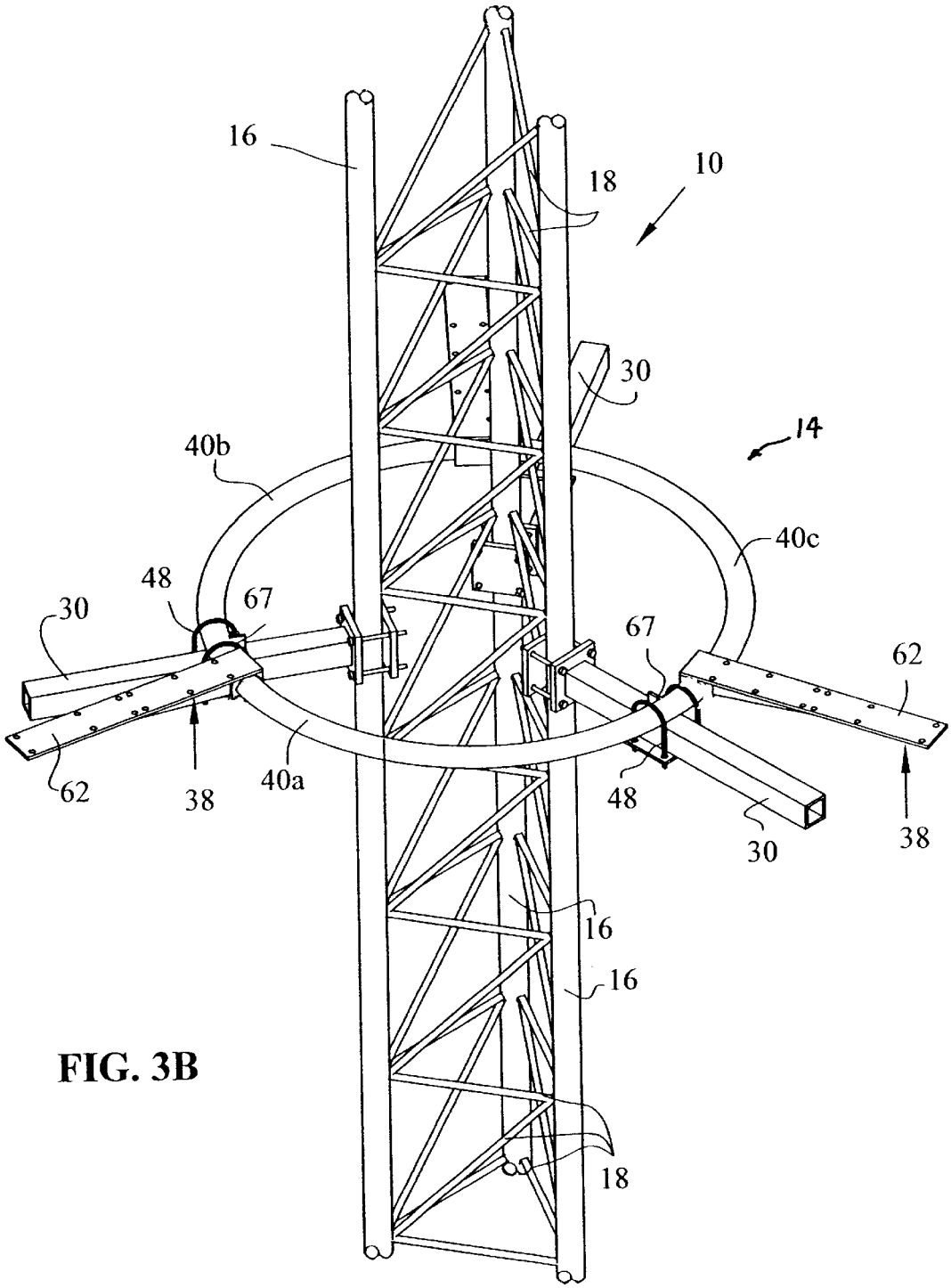
FIG. 3B is a perspective view of the lattice tower showing the rotational members rotated to the opposite stopping point when the rotational members are mounted to the tower mounting members.

Once mounted, if the azimuth of antenna platform 12 needs to be adjusted, the nuts 52, which secure U-bolts 48, may be loosened somewhat without removing the nuts completely from the threaded ends of the U-bolts. This will allow ring 36 to be slidingly rotated within a 120-degree arc in order to align the platform azimuth as desired. The range of rotation is limited to 120 degrees with the U-bolts attached as the platform mounting members 38 will come into contact with the U-bolts precluding further rotation as is shown in FIGS. 3A and 3B. If the desired azimuth cannot be attained in the 120 degree range that is available with the U-bolts loosened but still connected as- above, then U-bolts 48 may be removed and the platform moved to any desired azimuth. Of course, centering clamps 67 will keep the ring and platform centered and once the desired position has been obtained, U-bolts 48 will be repositioned and secured about the ring 36 with one on either side of each tower mounting member 30. Of course, the above steps may be repeated whenever it is desired to realign the azimuth of the antenna platform 12.

While the invention has been taught with specific reference to the embodiment detailed above and shown in the attached Figures, one skilled in the art will realize that changes may be made in form and detail without departing from the spirit and scope of the invention. First, the tower configuration is not restricted to a lattice-type tower or the particular configuration shown. Also for example, although the ring has been shown composed of three ring segments, attached to gussets of the platform mounting members, more or less segments may be used for the ring, or the ring may be made as singular piece. If a singular piece ring were used, then the platform mounting members may be attached thereto with clamps, by welding or other means well known in the art. Nor does the ring have to have a circular cross section. Also, a disc may be used instead of a ring and wheels or rollers may be used to facilitate rotation.

It should also be realized that a motor and gearing may be attached to the mounting assembly so that the antenna platform may be rotated automatically without the need for manual adjustment.

In addition, the mounting and adjusting procedure may be varied by attaching U-bolts 48 but not tightening the bolts snuggly and then rotating the ring. As discussed above; however, while the U-bolts are attached, rotation is limited to a 120-degree arc. The U-bolts must, of course, be completely removed to rotate the ring beyond this. Also, although the invention has been taught to first attach the mounting assembly to the tower prior to attaching the antenna platform to the mounting assembly, it will become apparent that the antenna platform may be pre-attached to the platform mounting members prior to attaching the assembly to the tower. However, it is more cumbersome to work with the assembly in this manner.

Additionally, the U-bolts that retain the ring may be mounted through optional holes in the tower mounting members (not shown) so that they are attached directly to the tower mounting members. This would eliminate the need to have separate centering clamps to maintain the ring concentric about the tower's axis. It should also be realized, that other clamp and fastener configurations may be substituted for the clamps bolts, and U-bolts depicted. The scope of the invention is therefore not limited by the figures and detailed description above, but rather, is indicated by the attached claims and equivalents thereof.

What is claimed is:

1. A mounting assembly for rotatably mounting an antenna platform to a lattice tower, said mounting assembly comprising tower mounting members, platform mounting members, and rotational members configured to surround the tower and be slidable on said tower mounting members, and said platform mounting members are fixed to said rotational members to facilitate rotation of the antenna platform about a longitudinal axis of the tower.

2. The mounting assembly as set forth in claim 1, wherein said rotational members include a ring.

3. The mounting assembly as set forth in claim 2, wherein said ring includes ring segments.

4. The mounting assembly as set forth in claim 3, wherein said ring includes three ring segments and said mounting assembly enables rotation of the antenna platform along a 120-degree arc while connected to the tower.

5. The mounting assembly as set forth in claim 3, wherein said platform mounting members are attached to said ring between said segments thereof.

6. The mounting assembly as set forth in claim 5, wherein said platform mounting members have a plate and a gusset, and said ring segments have flanges attached at the ends thereof.

7. The mounting assembly as set forth in claim 6, wherein each of said flanges of said ring segments is attached to one of said gussets on one of said platform mounting members.

8. The mounting assembly as set forth in claim 6, wherein said ring is mounted to be slidable upon said plates of said tower mounting members.

9. The mounting assembly as set forth in claim 8, wherein said ring may be secured to preclude slidable movement relative to said tower mounting members.

10. The mounting assembly as set forth in claim 9, wherein the ring is mounted to the tower mounting members with U-bolts.

11. The mounting assembly as set forth in claim 1 further comprising centering means for centering the platform about the axis of the tower while said rotational members are being rotated.

12. An antenna platform and mounting assembly configured for mounting on a lattice tower and allowing rotational movement of the antenna platform about the tower, said antenna platform comprising a frame and antenna mounting members, said mounting assembly comprising tower mounting members designed to extend radially outward from an axis of the tower for attaching said mounting assembly to the tower, platform mounting members for attaching said antenna platform to said mounting assembly, and rotational means supported by said tower mounting members for facilitating the rotation of the antenna platform about the longitudinal axis of the tower, said mounting assembly enabling said antenna platform to be set at any desired position about a 360-degree azimuth.

13. The antenna platform and mounting assembly as set forth in claim 12, wherein said rotational means includes a ring.

14. The antenna platform and mounting assembly as set forth in claim 13, wherein said ring includes ring segments.

15. The antenna platform and mounting assembly as set forth in claim 14, wherein said ring has three ring segments and said antenna platform is rotatable about a 120-degree arc while connected to the tower.

16. The antenna platform and mounting assembly as set forth in claim 15, wherein said platform mounting members are attached to said ring between said segments thereof.

17. The antenna platform and mounting assembly as set forth in claim 16, wherein said platform mounting members have a plate and a gusset, and said ring segments have flanges attached at the ends thereof.

18. The antenna platform and mounting assembly as set forth in claim 17, wherein each of said flanges of said ring segments is attached to one of said gussets on one of said platform support brackets.

19. The antenna platform and mounting assembly as set forth in claim 13, wherein said ring is mounted to be slidable relative to said tower mounting members.

20. The antenna platform and mounting assembly as set forth in claim 19, wherein said ring may be secured to preclude slidable movement relative to said tower mounting members.

21. The antenna platform and mounting assembly as set forth in claim 20, wherein said ring is mounted to said tower mounting members with U-bolts.

22. The antenna platform as set forth in claim 12 further comprising centering clamps to maintain centering of said antenna platform about the tower while said rotational members are being rotated.

23. A tower having a rotatable antenna platform comprising a mounting assembly for rotatably mounting said antenna platform to said tower, said mounting assembly including tower mounting members for attaching said mounting assembly to said tower, platform mounting members for attaching the antenna platform to the mounting assembly, and rotational members to facilitate rotation of the antenna platform about a longitudinal axis of the tower, said rotational members having a plurality of rotational segments joined by said platform mounting members.

24. The tower as set forth in claim 23, wherein said rotational members include a ring.

25. The tower as set forth in claim 24, wherein said rotational segments include ring segments.

26. The tower as set forth in claim 25, wherein said ring includes three ring segments, and said mounting assembly enables rotation of said antenna platform along a 120-degree arc while said antenna platform is attached to said tower.

27. The tower as set forth in claim 25, wherein said platform mounting members are attached to said ring between said ring segments thereof.

28. The tower as set forth in claim 27, wherein said platform mounting members have a plate and a gusset, and said ring segments have flanges attached to the ends thereof.

29. The tower as set forth in claim 28, wherein said flanges of each of said ring segments are attached to one of said gussets on one of said platform support brackets.

30. The tower as set forth in claim 24, wherein said ring is mounted to be slidable relative to said tower mounting members.

31. The tower as set forth in claim 30, wherein said ring may be secured to preclude a slidable movement relative to said tower mounting members.

32. The tower as set forth in claim 31, wherein said ring is mounted to said tower mounting members with U-bolts.

33. The tower as set forth in claim 32, wherein said tower is a lattice-type tower.

34. The tower as set forth in claim 33, wherein said lattice tower includes three vertical support legs joined to one another by trusses.

35. The tower as set forth in claim 23 further comprising centering means for maintaining centering of the platform relative to the longitudinal axis of the tower, while said rotational members are being rotated.

36. The tower as set forth in claim 35, wherein the centering means are attached to said tower mounting members and have a T-shaped configuration including a flange and a retaining plate, said flange being perpendicular to said retaining plate, and said rotational members include a ring, said centering means being juxtaposed on inner diameter of said ring.

* * * * *